US005551711A

United States Patent [19]

Mangelsdorf

[11] Patent Number: 5,551,711

[45] Date of Patent: Sep. 3, 1996

[54] BRAKING MECHANISM FOR IN-LINE SKATE

[76] Inventor: Gary Mangelsdorf, 8400 Grizzly Way, Evergreen, Colo. 80439

[21] Appl. No.: 393,659

[22] Filed: Feb. 24, 1995

[51] Int. Cl.[6] ..... A63C 17/14

[52] U.S. Cl. ..... 280/11.2; 280/11.22; 188/5

[58] Field of Search ..... 280/11.19, 11.2, 280/11.22, 11.27, 811; 188/5, 74

[56] References Cited

U.S. PATENT DOCUMENTS

| | | | |
|---|---|---|---|
| 2,644,692 | 5/1951 | Kahlert | 280/11.2 |
| 4,273,345 | 6/1981 | Ben-Dor et al. | 280/11.22 |
| 5,067,736 | 1/1991 | Olson et al. | 188/5 |
| 5,183,276 | 2/1993 | Pratt | 280/11.22 |
| 5,192,088 | 3/1993 | Yu | 280/11.22 |
| 5,197,572 | 3/1993 | Roberts | 188/5 |
| 5,335,924 | 8/1994 | Richards, Sr. et al. | 188/5 |
| 5,348,320 | 9/1994 | Gay | 280/11.22 |

*Primary Examiner*—Eric D. Culbreth
*Assistant Examiner*—Min Yu

[57] ABSTRACT

A brake mechanism for an in-line roller skate, the skate having a base plate the upper portion of which mounts a boot and a lower portion of which mounts a plurality of wheel assemblies, the brake mechanism including a support member depending downwardly from one side of the base plate, and a brake element having a lower end to which is attached a brake pad having a generally flat brake surface, the brake element mounted to the support member for adjustable movement relative to the support member along an arcuate path, and the brake pad surface maintained in alignment with a plane extending from a longitudinal axis through the lower ends of the plural wheels. A clamping mechanism can releasably hold the brake element stationary relative to the support member, and when the skate is tilted about the longitudinal axis through the wheel lower ends, the brake pad surface will be brought to lie flat against the ground.

12 Claims, 2 Drawing Sheets

BRAKING MECHANISM FOR IN-LINE SKATE

BACKGROUND OF THE INVENTION

1. Field of the Invention

This invention pertains to an in-line skate, and more particularly, to a braking device for an in-line skate, such brake as will closely simulate the sideways braking action of a hockey skate or snow ski. The brake system can be for new in-line skates or retrofitted to an existing in-line skate.

2. Description of the Prior Art

In-line skating has become a popular form of exercise and sport worldwide, to the extent that there now exist indoor hockey rinks built solely for the use of roller hockey. In-line skaters, especially those playing roller hockey, often resort to the same type of braking action used by ice skaters, commonly referred to as a "hockey stop." This is not always effective because the skaters are not always able to stop their motion, or, at best, are able to stop their motion only within the wide arc created by the lead skate in said braking motion. In fact, almost all of the braking occurs, not by turning the skate, but by dragging the rear skate along the ground. One problem is that currently available in-line skates are straight-line orientation.

At present, the most widely used braking mechanism available for in-line skates is one which is secured to the rear portion of the boot and which comprises a flat fixed brake pad intended to abrade the skating surface. The skater applies the brake by extending the skate slightly forward and lifting the front wheels off the ground, thereby applying the rear brake pad to the skating surface and frictionally stopping the forward motion of the skater. This mechanism is undesirable in that it requires the user, to thrust his foot forward of his body, thus putting him in an awkward and out-of-balance position. Said motion becomes even more difficult on uneven or pitched terrain. U.S. Pat. No. 5,028,058 typifies this type of brake on currently available in-line skates, and similar mechanisms can be found described in U.S. Pat. Nos.: 5,067,736; 5,183,275; 5,192,088; and 5,197,572.

Two other patents circumvent this foot-tilting problem through the use of a mechanically-operated rear pad (U.S. Pat. No. 5,211,409) and a hand-held lever-and-cable caliper system (U.S. Pat. No. 5,239,941). In both cases, the skater squeezes hand levers connected to cables running out his arms and down his sides and legs to the skate. In the former case, the cable connects to a rocker arm which pivots a rear brake pad to the ground. In the latter case, the cable connects to caliper-type brake pads, mounted to the sides of the wheel(s). By squeezing the hand lever, the user forces the brake pads into the sides of the wheel(s), thus forcing the skate to stop. These two systems are ineffective because they are both cumbersome and dangerous, dangerous because the skater's hands are never free of the levers in case he needs them to break a fall or regain his balance by grabbing onto something.

A brake system described in U.S. Pat. No. 5,207,438 calls for a toe-mounted brake. In use, the skater extends his foot rearwardly to position a rotatable cylinder, mounted on the toe of the boot, onto the skating surface, thereby creating enough friction between the cylinder and the ground to slow the forward motion of the skate. This system is undesirable because it places the skater in an awkward, unbalanced position, the rear skate being too difficult to control as one rolls along.

SUMMARY OF THE INVENTION

In view of the foregoing problems and disadvantages associated with the prior art, it is a general object of the present invention to provide a braking mechanism for in-line skates which is capable of applying large magnitude braking forces to the skate in a controlled, sideways motion, similar to that typically used by ice skaters and snow skiers.

Another object of this invention is to provide an adjustable braking mechanism.

A further object is to ensure maximum contact between the brake pad and the skating surface, regardless of pad setting.

An additional object of the invention is to allow a quicker, more controlled stopping motion than is currently available with in-line skates.

Yet another object of the present invention is to provide a brake that reduces vibrations transmitted to the skates on uneven or sloped surfaces, thereby making skating safer on all non-slip surfaces of any reasonable,pitch.

The foregoing objects and advantages are provided by the present invention which is applicable to a skate that includes an elongate base plate having a boot secured to its upper portion and a plurality of wheel assemblies attached to its underside in in-line fashion. The inventive brake mechanism includes a brake element having a lower end to which a brake pad is secured, the pad having a generally flat brake surface, and there is means on one side of the base plate for supporting the brake element for adjustable movement that raises or lowers the brake pad along an arcuate path such that the pad surface is maintained in general alignment with a plane extending from a longitudinal axis through the ground-engaging lower ends of the plural wheels, and including means for releasably clamping the brake element against movement relative to the supporting means. Thus the skate, at all brake settings, can be tilted or canted about the ground-engaging wheels to bring the brake pad surface flatly against the ground.

In a preferred embodiment the brake pad is longitudinally extending, and the brake mechanism is attached to the rearward half of the base plate.

These and other features and advantages of the invention will become more clearly understood upon consideration of the following detailed description and accompanying drawings.

DETAILED DESCRIPTION OF THE INVENTION

Figure 1:
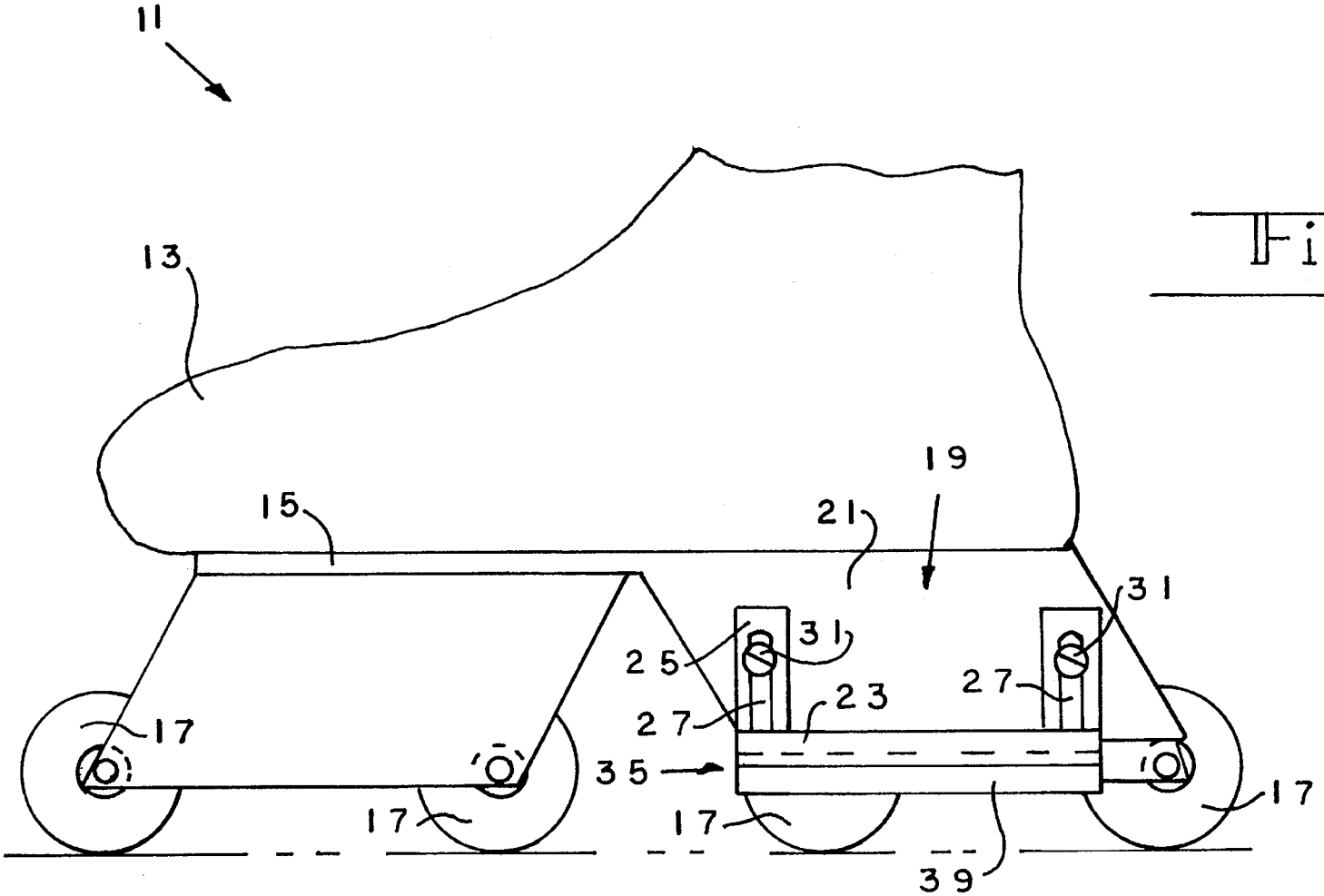
FIG. 1 is a side elevational view showing a brake mechanism according to the present invention.

Referring now to the drawings, FIG. 1 shows a skate 11 comprising a boot 13, base plate 15, and wheel assemblies for rotatably mounting four in-line wheels 17.

Figure 2:
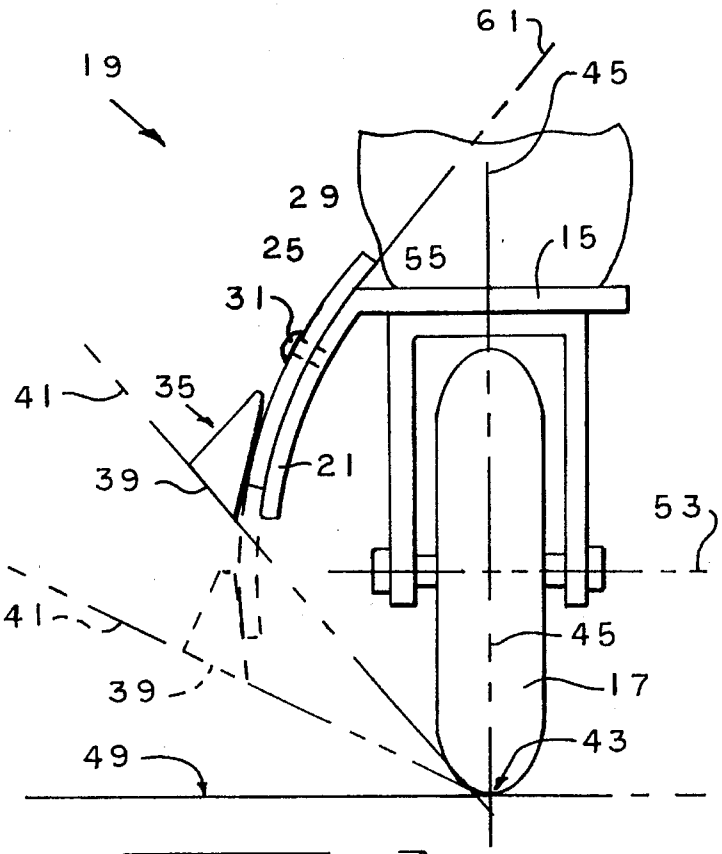
FIG. 2 is a rear elevational view of the mechanism of FIG. 1.

A preferred embodiment of the invention is shown in the brake mechanism 19 that includes a support plate 21 that extends in a curved manner downwardly from one side of the metallic base plate 15, to which it is integral, as best shown in FIG. 2. In this embodiment the mechanism 19 attaches to the side of the base plate corresponding to the arch of the boot 13. There can be embodiments of the invention that have brake mechanisms on both sides of the base plate.

As FIG. 1 shows, there is an adjustable brake element that has cross piece 23 and twin brackets 25, each having a slot 27. As FIG. 2 shows, the inside surfaces of brackets 25 match the curvature of the outside surface 29 of support plate 21. A pair of clamping bolts 31 reside in slots 27 and their threaded ends are received in support plate 21. It is noted that a brake pad 35, of a suitable polymeric material such as polyurethane, is secured to the cross piece 23 by means of a suitable adhesive or suitable fasteners. Pad 35 is provided with an elongate, generally flat surface 39 that is designed to be engaged with the ground when the skate 11 is used, in a manner to be described. When bolts 31 are loosened, the brackets 25 can be slidably adjusted upwardly and downwardly, along an arcuate path according to the curvature of surface 29. Tightening of bolts 31 will secure the brackets, and thus the pad 35, against movement relative to support 21.

FIG. 2 shows the mechanism 19 adjusted to hold pad 35 in a raised position. Dashed lines illustrate pad 35 in a lowermost position. The reference numeral 41 represents a plane extending from, and aligned with, the brake pad surface 39. When pad 35 is in its lowermost position, the plane 41 will be held in general alignment with an axis 43 through the lowermost parts of upright wheels 17. In this preferred embodiment, as the brake pad 35 is moved upwards towards its raised position, the downward slope of plane 41 will be caused to increase such that plane 41 will be moved downwardly away from the axis 43, so as to intercept points along the vertical Wheel axis 45, below axis 43. It will be seen that when skate 11 is canted about the contact line of engagement of wheels 17 with a generally flat surface 49, such as tilting to the left as viewed in FIG. 2, the ground-engaging points will shift to the left along the bottom portion of wheels 17. Thus when skate 11 is canted for braking, the plane 41 of pad surface 39 will be held in substantial alignment with the shifting ground-engaging points of wheels 17, at all locations to which the pad 35 is adjusted.

Adjustment of mechanism 19 is made according to the preference of the skate user.

In the preferred embodiment of FIG. 2, the curvature of surface 29 has a radius that is larger than the diameter (72 mm) of standard wheel 17, and is about 3 inches. The center of curvature lies in proximity to a plane through the wheel rotational axis 53. Here the curved surface 29 curves downwardly from a point 55 which is about 45 mm above axis 53, and 20 mm to the left of vertical axis 45. A tangent 61 through point 55 will lie at about 20 degrees to the vertical. It is also preferred that the center of curvature lie to the right, and above the axis 45, and near the plane of wheel axes 53. This feature provides the additional advantage of giving the skate a relatively narrow frontal profile. Also it is preferred that the brake mechanism 19 be attached adjacent the rearward half of skate 11, as shown.

Figure 3:
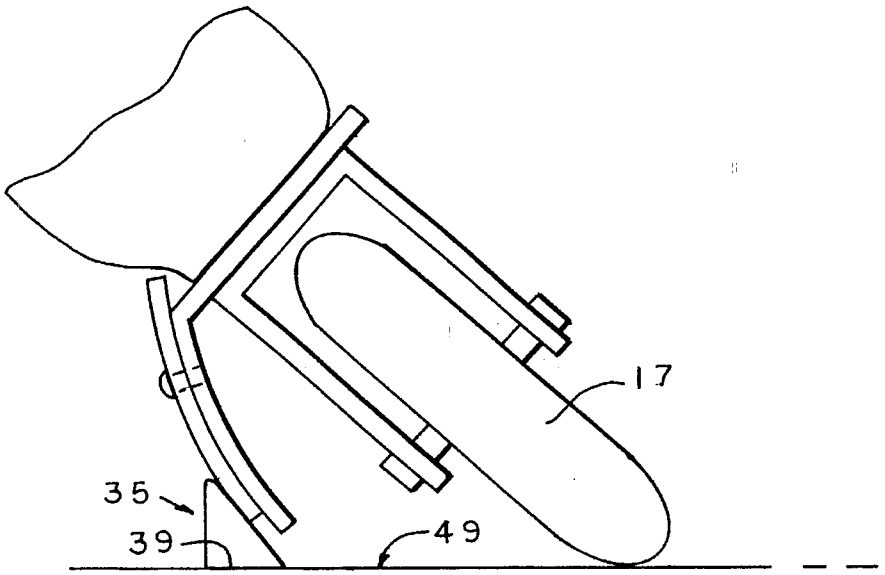
FIG. 3 is a rear view showing operation of the mechanism of FIG. 2.

FIG. 3 illustrates how mechanism 19 is used to brake the skate 11 on a surface 49.

While a particular embodiment of the invention has been described, it is not intended that the invention be limited thereto. Various modifications and variations may readily occur to those of ordinary skill in the art, given the benefit of this disclosure, without departing from the full scope and breath of the invention as defined in the claims which follow.

What is claimed is:

1. A braking mechanism on an in-line roller skate, said skate including a boot, an elongate base plate having a longitudinal axis, a rearward half, and an upper portion to which said boot is secured, and a plurality of in-line wheel assemblies supported from the lower portion of said base plate, said plate having first and second opposite sides, and said assemblies including wheels aligned one behind the other and disposed in a common plane that is through said longitudinal axis and perpendicular to the rotational axes of said wheels, and said wheels having lower end portions for engaging a travel surface, said braking mechanism including:

a) a brake element having a lower end to which a brake pad is secured, the pad having a generally flat brake surface;

b) means on at least one of said opposite sides of said base plate including an arcuate guide surface slidably and lockably engaged by said brake element and having an axis of curvature parallel to said longitudinal axis for supporting the brake element lower end laterally spaced a predetermined distance from said common wheel plane for adjustable movement that raises or lowers the pad along an arcuate path that has an axis of curvature parallel to said longitudinal axis such that the plane of said pad surface is maintained in substantial alignment with said wheel lower end portions, and whereby said pad surface is adapted to engage said travel surface when said common wheel plane achieves a predetermined acute angle to said travel surface; and c) clamp means for releasably securing said brake element against movement relative to said supporting means.

2. A braking mechanism as defined in claim 1 wherein said wheel lower portions include a central lowermost portion for engaging a flat surface when said wheels are upright, and portions spaced on opposite sides of said central portion for engaging said said ground surface when said wheels are tilted, and whereby said pad is adjustable from a lowered position to a raised position along said path, and wherein the plane of said pad surface is aligned with said central lowermost wheel portion when said pad is in its lowered position, and aligned with wheel portions spaced laterally of said central portion when said pad is in its raised position.

3. A braking mechanism as defined in claim 1 wherein said pad is adjustable from a lowered position to a raised position, and wherein the angle between said pad surface and said common plane is decreased as said pad is moved from its lowered position to its raised position.

4. A braking mechanism as defined in claim 1 wherein said brake element support means provides an arcuate surface, and said brake element has an arcuate surface for slidably engaging said support means arcuate surface.

5. A braking mechanism as defined in claim 1 wherein said arcuate path extends downwardly from a side of said base plate.

6. A braking mechanism as defined in claim 1 wherein said arcuate path has a radius of curvature at least as large as the diameter of said wheels.

7. A braking mechanism as defined in claim 6 wherein said radius of curvature is about 3 inches.

8. A braking mechanism as defined in claim 6 wherein the radius of curvature is in the proximity of a plane through the rotational axes of said wheels.

9. A braking mechanism as defined in claim 1 wherein said pad surface is longitudinally elongated.

10. A braking mechanism as defined in claim 1 wherein said pad is supported adjacent the rearward half of said base plate.

11. A braking mechanism as defined in claim 10 wherein said skate has four wheels and said pad is supported adjacent the two rearward ones of said wheels.

12. A braking mechanism as defined in claim 5 wherein said base plate side is about 20 mm laterally of a vertical plane bisecting said wheels, and about 45 mm above a horizontal plane containing the rotational axes of said wheels, and said wheels have diameters of about 72 mm.

* * * * *